United States Patent [19]

Oda et al.

[11] 4,304,585

[45] Dec. 8, 1981

[54] METHOD FOR PRODUCING A THERMAL STRESS-RESISTANT, ROTARY REGENERATOR TYPE CERAMIC HEAT EXCHANGER

[75] Inventors: Isao Oda; Tadaaki Matsuhisa, both of Nagoya, Japan

[73] Assignee: NGK Insulators Ltd., Japan

[21] Appl. No.: 75,184

[22] Filed: Sep. 13, 1979

[30] Foreign Application Priority Data

Sep. 28, 1978 [JP] Japan ..... 53-118551

[51] Int. Cl.[3] ..... C03C 27/04

[52] U.S. Cl. ..... 65/43; 264/60; 264/63

[58] Field of Search ..... 165/10; 65/43; 264/60, 264/63

[56] References Cited

U.S. PATENT DOCUMENTS 1,888,341 11/1932 Winckler ..... 65/43
3,251,403 5/1966 Smith .
3,773,484 11/1973 Gray, Jr. ..... 65/43 X
4,020,896 5/1977 Mold et al. ..... 65/43 X

*Primary Examiner*—Arthur D. Kellogg
*Attorney, Agent, or Firm*—Stevens, Davis, Miller & Mosher

[57] ABSTRACT

A thermal stress-resistant rotary regenerator type ceramic heat exchanger comprising a plurality of ceramic honeycomb structural matrix segments bonded by a ceramic binder is produced by extruding a plurality of ceramic honeycomb structural matrix segments, firing the segments, bonding the segments with one another by application of a ceramic binder, said ceramic binder after the subsequent sintering having substantially the same mineral composition as said ceramic matrix segments and the thickness of 0.1 to 6 mm, and a difference in thermal expansion being not greater than 0.1% at 800° C. relative to the ceramic matrix segments, drying the bonded segments, and firing the dried bonded segments.

3 Claims, 6 Drawing Figures

METHOD FOR PRODUCING A THERMAL STRESS-RESISTANT, ROTARY REGENERATOR TYPE CERAMIC HEAT EXCHANGER

This invention relates to a rotary regenerator type ceramic heat exchanger which is excellent in a heat-exchanging efficiency, small in pressure drop and resistant to thermal stress, and a method for fabricating same.

Rotary regenerator type ceramic heat exchanger is generally composed of a cylindrical matrix having a honeycomb structure with a diameter of 30 cm to 2 m and circular rings disposed along the periphery of the matrix to hold it. The heat exchanger is partitioned into halves by means of a sealing member and is rotatably disposed in a fluid passage separated into two sections by sealing means, through which a hot fluid and a fluid to be heated are flowed, respectively. By rotation of the heat exchanger, each half thereof is alternately heated by the hot fluid in one of the two sections and cooled by giving the regenerated heat to the fluid to be heated in the other section. Accordingly, the ceramic heat exchanger is required to have such characteristics as good heat exchanging efficiency and small pressure drop which feature permits a fluid to smoothly flow therethrough.

Several types of rotary regenerator type ceramic heat exchangers have been heretofore known including a so-called corrugated hoenycomb structure produced by spirally winding alternate layers of corrugated and flat sheets and so-called embossed hoenycomb structure obtained by embossing a thin flat ceramic sheet to form ribbed tape and wrapping the ribbed tape around a mandrel. However, the former exchanger has a disadvantage that since the cellular structure of the honeycomb is in the form of a corrugation or a sinusoidal triangle with a radius of curvature and the inner surfaces of the cells through which a fluid is passed can be hardly made smooth, and further, dead spaces are apt to be formed between the corrugated and flat sheets, therefore the fluid is difficult to flow uniformly in said dead spaces, leading to a great loss of pressure, and high heat-exchanging efficiency could not be expected. The latter structure is also disadvantageous in that delamination tends to occur at bonding portions between the ribs and the back web, so that it is unsatisfactory in mechanical strength and tends to be damaged by thermal stress imposed thereon in use.

The present invention contemplates to provide a ceramic heat exchanger of the regenerator type which is devoid of the drawbacks involved in the prior art counterparts and which is excellent in heat-exchanging efficiency, small in pressure drop and resistant to thermal stress.

The present invention is characterized by provision of a monolithically integrated honeycomb structure which is obtained by providing a plurality of matrix segments of a honeycomb structure made of a ceramic material and formed by an extrusion technique, sintering the matrix segments, bonding the segments with one another by application of a ceramic binder so as to obtain the thickness of 0.1 to 6 mm after sintering, said ceramic binder after the subsequent sintering having substantially the same mineral composition as the matrix segment and a difference in thermal expansion of not greater than 0.1% at 800° C. relative to the ceramic segments, and sufficiently drying and sintering the bonded structure. The present invention also provides a method for fabricating a rotary ceramic heat exchanger of the just-mentioned type.

The present invention will be described in more detail.

A ceramic raw material such as cordierite or mullite which is relatively small in thermal expansion coefficient is extruded to form a matrix segment of a honeycomb structure having any sectional cellular shape such as a triangle, a quadrangle including a square and rectangle, or a hexagon. Then, the segment is solidified by sintering and a plurality of such segments are provided and processed so as to make a configuration suitable as a rotary ceramic heat exchanger of the intended regenerator type. The thus processed segments are bonded together by applying a ceramic binder to the bonding portions of each of the segments. The applied ceramic binder should have upon sintering substantially the same mineral composition as that of the matrix segment and a difference in thermal expansion between the binder and the ceramic segment in the range of not greater than 0.1% at 800° C. The ceramic binder is applied such that thickness after the sintering is in the range of 0.1 to 6 mm. The matrix structures applied with the binder and bonded with each other are then sufficiently dried and sintered until the binder is satisfactorily sintered and solidified to give a monolithic honeycomb structure. The honeycomb structure thus obtained is found, when applied as a rotary heat exchanger of the regenerator type, to be excellent in heat-exchanging efficiency, small in pressure drop and resistant to thermal stress.

Since the matrix segments constituting the ceramic heat exchanger according to the present invention are formed by an extrusion technique, the cellular structure is uniform and the cell surfaces in an axial direction along which a fluid is passed are smooth, which allows easy passage of fluid therethrough with a minimized pressure drop as well as excellent heat exchanging performance.

One of important features of the present invention resides in a technique of bonding a plurality of ceramic segments obtained by the extrusion. According to the invention, the bonding of a plurality of ceramic segments is effected by the use of the ceramic binder of the specific type as described hereinbefore. It is essential that the ceramic binder has, upon sintering, substantially the same mineral composition as that of the matrix segment and a difference in thermal expansion therebetween of not greater than 0.1% at 800° C. and that a thickness of 0.1 to 6 mm after the sintering. It has been found that the binder portions after the sintering have mechanical strengths and a thermal stress resistance equal to or greater than those of the segment matrix portions, ensuring fabrication of a rotary ceramic heat exchanger which is excellent in heat-exchanging efficiency and small in pressure drop. The term "thickness" in the bonding portions as used herein is intended to mean a total of thicknesses of thin walls of adjacent matrix segments to be bonded together and a thickness of the binder after sintering. In the case where the surface of the matrix segment to be bonded is irregular as shown in FIGS. 4 to 6, the bonding thickness may be defined as that obtained by dividing a cross-sectional area of the bonding portion by its length. When voids are present in the bonding area of a segment as shown in FIG. 6, the bonding thickness is defined as being free of such voids.

Further, the language "substantially the same mineral composition as that of the matrix segment after sintering" herein means that the ceramic binder has the same mineral components and content of such components as the matrix segment except possible impurities in a total amount not greater than 1%. The use of such binder ensures high strength of bonding to the matrix segments and small difference in thermal expansion coefficient. The bonding thickness greater than 6 mm after the sintering is not favorable since an open frontal area and a sectional area for passage of fluid decrease, resulting in an increase of pressure drop and a decrease of the heat-exchanging efficiency. In addition, because of shrinkage of the bonding layer upon sintering, matrix segments tend to separate at the bonding portions and thus greater thickness of the bonding layer is not favorable. Furthermore, when the thickness of the bonding portion is more than 6 mm, difference occurs in the sintering ability at the bonding portion and the matrix portion and the thermal expansion of the bonding portion becomes larger and the thermal stress-resistance lowers and such a structure is not preferable and further when such a structure is used as a rotary regenerator, the local thermal strain is caused due to the difference of the heat capacity at the matrix portion and the bonding portion and the thermal stress-resistance lowers. Smaller thicknesses than 0.1 mm have drawbacks that separation tends to take place upon sintering in bonded areas because of insufficiency of mechanical strengths in the bonded area and that the resistance to thermal stress becomes lowered.

When the difference in thermal expansion between the binder and the ceramic matrix segment is greater than 0.1% at 800° C., the resistance to thermal stress at the bonding portion is undesirably lowered. Preferably, the thickness of the bonding layer or portion is in the range of 0.5 to 3 mm and the difference in thermal expansion is in the range not greater than 0.05% at 800° C. with respect to heat-exchanging efficiency, pressure drop and resistance to thermal stress.

The ceramic binder applied to the matrix segments is the form of a ceramic paste composed of ceramic powder, an organic binder and a solvent. The solvent may be an aqueous or organic solvent, which depends on the type of the organic binder employed. The ceramic powder may be those which have after sintering, substantially the same mineral composition as the matrix segment, and a difference in thermal expansion with the matrix segment of not greater than 0.1% at 800° C. Illustrative of the ceramic powders are non-treated powders such as talc, kaolin and aluminum hydroxide, calcined powders such as calcined talc, calcined kaolin and calcined alumina, sintered powders such as of cordierite, mullite and alumina, and a mixture thereof.

In order to improve the bonding strength, it is preferred that the bonding area be increased by rendering the bonding surface of the matrix rough or irregular as shown in FIGS. 4 to 6.

If voids are present in certain sections of the bonding portion or through the bonding portion along the length of the cell as shown in FIG. 6, it is desirable to make the area of the voids not greater than ½ times that of the bonding area in the bonding portion of each section.

The following examples will further illustrate the present invention.

EXAMPLE 1

A cordierite raw material was used to form, by extrusion, ceramic segments of a cellular structure of a triangle form having a pitch of 1.4 mm and a wall thickness of 0.12 mm, followed by sintering in a tunnel kiln at 1,400° C. for 5 hours to give 35 matrix segments each having a size of 130×180×70 mm. The 35 segments were arranged and partly processed on the outer periphery thereof so as to make, after bonding, a rotary regenerator-type heat exchanger of an intended form. Thereafter, a ceramic paste binder which produced a cordierite mineral after sintering was applied to the individual segments so that the thickness of the bonding layer after sintering was 1.5 mm and then assembled. The resulting assembled body was sufficiently dried and sintered in a tunnel kiln at 1,400° C. for 5 hours to obtain a rotary heat exchanger of an integrated structure having a diameter of 700 mm and a thickness of 70 mm.

The thus obtained heat exchanger was found to have an open frontal area of 70%, and a difference in thermal expansion between the matrix segment and the bonding material of 0.005% at 800° C. The bending strength of the matrix structure was found to be 13.7 kg/cm$^2$, with or without including the bonding portions, as determined by a four point bending test, showing no lowering of the strength by the bonding. When the heat exchanger was subjected to a rapid heating and rapid cooling thermal stress test wherein it was placed in an electric furnace maintained at a predetermined temperature, held for 30 minutes and then removed from the furnace for air-cooling, it was found that no crack was produced in the bonding portion though some cracks were produced in the matrix portions in the case of a temperature difference of 700° C. The rotary ceramic heat exchanger of the regenerator type thus obtained was useful as a heat exchanger for gas turbine engines and Stirling engines.

EXAMPLE 2

Mullite segments of a honeycomb structure with cells of a square form having a pitch of 2.8 mm and a wall thickness of 0.25 mm were extruded and then sintered in an electric furnace at 1,350° C. for 5 hours to give 16 matrix segments with a size of 250×250×150 mm. The ceramic segments were partly processed on the outer peripheries thereof and applied at the bonding portions thereof with a ceramic paste, which produced a mullite mineral after sintering, in a thickness of 2.5 mm after sintering, followed by sufficiently drying and sintering in an electric furnace at 1,350° C. for 5 hours to obtain a rotary ceramic heat exchanger of an integrated configuration having a diameter of 1,000 mm and a thickness of 150 mm and composed of mullite.

This heat exchanger matrix was found to have an open frontal area of 80% and a difference in thermal expansion between the matrix segment and the bonding layer of 0.02% at 800° C. As a result of the rapid heating and rapid cooling thermal stress test conducted similarly to the case of Example 1, it was found that no crack was observed in the bonding portion in a temperature difference of 400° C. though cracks were produced in the matrix portions. The thus obtained rotary mullite heat exchanger matrix was found to be useful as an industrial heat exchanger.

As will be understood from the foregoing, the thermal stress resistant, rotary ceramic heat exchanger of the regenerator type of the present invention which has an integrated configuration has a uniform and smooth cellular structure, sufficiently high open frontal area, small pressure drop, and excellent heat-exchanging efficiency and resistance to thermal stress. Accordingly, the heat exchanger is very useful as rotary regenerator type heat exchanger for gas turbine engines and Stirling engines and also as an industrial heat exchanger used for saving fuel costs, and is as being just eagerly sought after.

Figure 1:
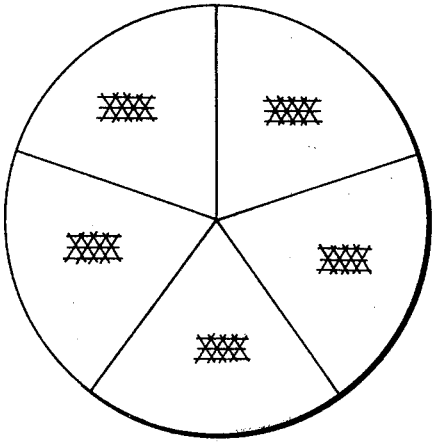
FIGS. 1 to 3 are views showing one embodiment of a ceramic heat exchanger matrix having bonding portions according to the invention.
Figure 2:
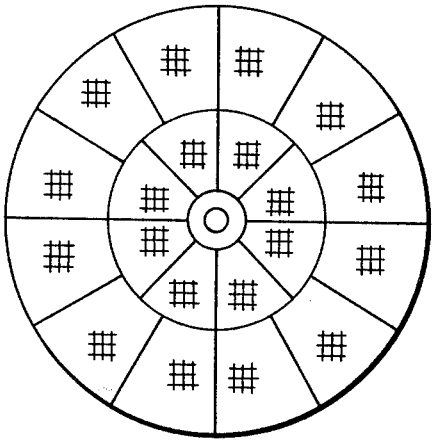
Figure 3:
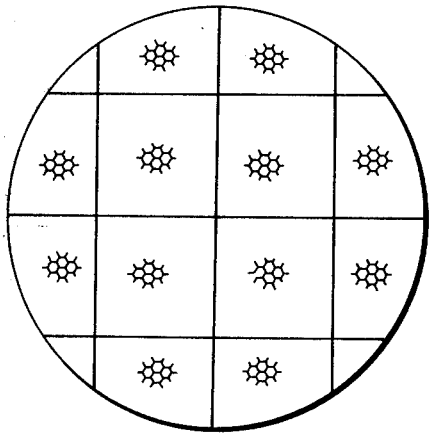
Figure 4:
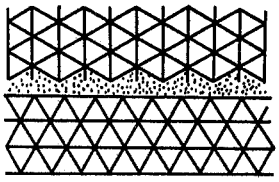
FIGS. 4 to 6 are enlarged views of sections of a bonding portion and an adjacent matrix portions.
Figure 5:
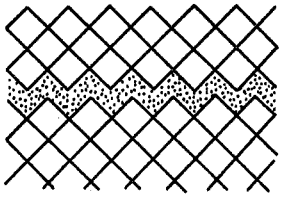
Figure 6:
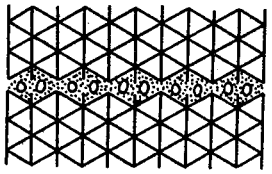

What is claimed is:

1. A method for producing a rotary regenerator type ceramic heat exchanger, which comprises extruding a plurality of ceramic honeycomb structural matrix segments from crystalline, particulate, ceramic-forming materials, each segment itself having a multiplicity of honeycomb openings therein, each segment further having opposed ends and an axis extending through said opposed ends in the direction of extrusion;

firing the segments;

bonding the segments side-by-side with one another so that the axes of the segments are substantially parallel with one another by application of a ceramic binder, said ceramic binder after the subsequent sintering having substantially the same mineral composition as said ceramic matrix segments and the thickness of 0.1 to 6 mm, and the difference in thermal expansion relative to the ceramic matrix segments being not greater than 0.1% at 800° C.;

drying the bonded segments; and firing the dried bonded segments.

2. A method as in claim 1 wherein the ceramic-forming material is codierite.

3. A method as in claim 1 wherein the ceramic-forming material is mullite.

* * * * *